United States Patent [19]

Podd, Sr. et al.

[11] Patent Number: 5,040,693

[45] Date of Patent: Aug. 20, 1991

[54] LINER FOR A CARGO CONTAINER AND A METHOD OF INSTALLING A LINER INSIDE A CARGO CONTAINER

[76] Inventors: Victor T. Podd, Sr.; Victor I. Podd, Jr.; Stephen D. Podd, all of 255 Beverly Avenue, Montreal, Quebec, Canada

[21] Appl. No.: 481,989

[22] Filed: Feb. 15, 1990

[51] Int. Cl.[5] ..... H05B 3/68

[52] U.S. Cl. ..... 220/1.5; 383/3; 383/12; 206/403; 410/52; 410/128; 410/140; 220/470; 220/461; 220/403

[58] Field of Search ..... 220/1.5, 470, 426, 415, 220/403, 461; 383/3, 12; 224/535, 564; 410/52, 128, 140; 206/522

[56] References Cited

U.S. PATENT DOCUMENTS

| | | | |
|---|---|---|---|
| Re. 29,721 | 8/1978 | Ukmar et al. . | |
| 1,259,320 | 3/1918 | Tyler . | |
| 1,815,653 | 7/1931 | Jones . | |
| 2,144,181 | 1/1939 | DuBois . | |
| 2,708,542 | 5/1955 | Gray et al. . | |
| 3,119,351 | 1/1964 | Ford . | |
| 3,142,265 | 7/1964 | Ford . | |
| 3,384,106 | 5/1968 | Isbrandtsen . | |
| 3,658,205 | 4/1972 | Kassravi . | |
| 3,756,469 | 9/1973 | Clark et al. . | |
| 3,757,990 | 9/1973 | Buth . | |
| 3,868,042 | 2/1975 | Bodenheimer . | |
| 3,951,284 | 4/1976 | Fell et al. . | |
| 3,980,196 | 9/1976 | Paulyson et al. . | |
| 4,054,226 | 10/1977 | Bjelland et al. . | |
| 4,165,024 | 8/1979 | Oswait et al. . | |
| 4,186,845 | 2/1980 | Podd . | |
| 4,231,481 | 11/1980 | Nash et al. | 220/461 |
| 4,232,803 | 11/1980 | Muller et al. . | |
| 4,334,812 | 6/1982 | Delatush . | |
| 4,345,862 | 8/1982 | Blout et al. . | |
| 4,399,737 | 8/1983 | Severson . | |
| 4,441,627 | 4/1984 | Takeuchi . | |
| 4,461,402 | 7/1984 | Fell et al. . | |
| 4,498,824 | 2/1985 | Kinkle . | |
| 4,595,126 | 6/1986 | Holmes . | |
| 4,674,127 | 6/1987 | Yamada et al. . | |
| 4,739,895 | 4/1988 | Bachmann | 220/461 |
| 4,799,607 | 1/1989 | Podd . | |
| 4,884,722 | 12/1989 | Podd . | |
| 4,909,410 | 3/1990 | Derby et al. | 220/461 |

FOREIGN PATENT DOCUMENTS

| | | |
|---|---|---|
| 1205106 | 5/1986 | Canada . |
| 533317 | 9/1931 | Fed. Rep. of Germany . |

*Primary Examiner*—Joseph Man-Fu Moy
*Attorney, Agent, or Firm*—Scully, Scott, Murphy & Presser

[57] ABSTRACT

A liner for a cargo container and a method of installing a liner inside a cargo container. The liner comprises an inflatable body and left and right connecting strips that are connected to the liner body. The left connecting strip extends along and laterally projects outside a bottom left edge of the liner body, and the right connecting strip extends along and laterally projects outside a bottom right edge of the liner body. The liner is placed inside the container, with the left connecting strip positioned on the container floor adjacent the left side wall of the container, and with the right connecting strip positioned on the container floor adjacent the right side wall of the container. These two connecting strips are then releasably clamped to the container floor, for example by securely nailing wooden slats to the container floor, over the connecting strips. Also disclosed is a method of fluidizing a bulk cargo inside a lined cargo container to facilitate unloading the cargo from the container.

20 Claims, 9 Drawing Sheets

LINER FOR A CARGO CONTAINER AND A METHOD OF INSTALLING A LINER INSIDE A CARGO CONTAINER

BACKGROUND OF THE INVENTION

The present invention generally relates to liners for cargo containers, and to a method of installing a liner inside a cargo container.

Standardized containers or boxes have come into very extensive use for the shipment of freight by land and sea, and the many advantages of such containers have made it extremely desirable to adapt them for use with as many types of cargo as possible Accordingly, there have been attempts, with varying degrees of success, to use conventional containers to carry bulk cargo such as dry bulk chemicals, powdered and pelletized resins, flour, coffee and grains.

When cargo containers are used to carry such bulk cargo, it is important that the container itself either be kept clean or be cleaned after each load of cargo is emptied from the container, so that the container can be subsequently used with another load of cargo. Moreover, it is important to protect the bulk cargo from contamination and from undesirable exposure to the natural elements.

For these reasons, large plastic removable liners are often used to line the interior walls or surfaces of the cargo containers that are used to carry bulk cargo. The liner protects the cargo during shipment, for example, from rain and debris; and after the cargo is delivered, the liner can be removed so that the container is again usable, without significant cleaning, to carry other cargo.

Various difficulties have been encountered, however, in using plastic liners in the above-described manner; and in particular, it has been found that the liners often tear or rupture under certain conditions. For example, a cargo container carrying bulk cargo is often emptied by opening the rear doors of the container, and raising the front end of the container to tilt the container so that the cargo slides out the back of the container. Prior art container liners often tear or rupture as the cargo slides rearward through the container and over the liner. Numerous attempts have been made to solve this problem by using braced cardboard or wood bulkheads to help support the liner inside the container, or by hanging the liner from the container roof or walls by means of a multitude of hooks connected to the top perimeter of the liner. These prior art attempts have not been completely successful; and it is believed that this is due, at least in part, to the fact that the exact specific factors causing liners to rip or tear have not been completely understood.

SUMMARY OF THE INVENTION

An object of the present invention is to improve the resistance of cargo container liners to tears and ruptures caused by bulk cargos inside the liners and containers.

Another object of this invention is to secure a liner inside a cargo container in a way that reduces or eliminates stretching of at least the front portion of the bottom of the liner as the container carries a bulk cargo and as that cargo is unloaded from the container.

A further object of the present invention is to strengthen the bottom panel of a container liner, for example, by applying a reinforcing layer to that bottom panel, or by making the liner or the bottom panel thereof from a high strength material such as a co-extruded or bi-axially oriented film, and to secure the liner inside a container by clamping left and right securing strips of the liner to a portion of the container floor extending rearward from a front panel or edge of the liner.

These and other objectives are attained with a liner for a cargo container of the type defining an interior cargo space and including at least a floor and left and right side walls. The liner comprises an expandable body having an expanded shape adapted to fit inside the cargo space, and including a front edge and bottom left and right edges The liner further includes a left connecting strip connected to the liner body, extending along the bottom left edge thereof from a position at least adjacent the front edge of the body and laterally projecting outside said bottom left edge; and a right connecting strip connected to the liner body, extending along the bottom right edge thereof from a position at least adjacent the front edge of the body, and laterally projecting outside said bottom right edge.

The liner is placed inside the container, with the left connecting strip positioned on the container floor, adjacent or against the left side wall of the container, and with the right connecting strip positioned on the container floor, adjacent or against the right side wall of the container. These two connecting strips are then releasably clamped to the container floor, and preferably this is done by securely nailing wooden slats to the container floor over the connecting strips.

With one embodiment, the left and right connecting strips are formed by a connecting panel that extends completely across and laterally projects outside the body of the liner. With an alternate embodiment, the left connecting strip of the liner is formed by folding or holding together two lower longitudinal edge portions of a left side panel of the liner body, and the right connecting strip of the liner is formed by folding or holding together two lower longitudinal edge portions of a right side panel of the liner body.

Preferably, the liner also includes a sleeve extending from the front edge of the liner body, and a wooden slat is inserted into this sleeve and nailed to the container floor, further securing the liner body in place inside the container body. Moreover, preferably, the liner still further includes a reinforcing panel extending over at least a substantial area of a bottom panel of the liner body.

Further benefits and advantages of the invention will become apparent from a consideration of the following detailed description given with reference to the accompanying drawings which specify and show preferred embodiments of the invention.

A BRIEF DESCRIPTION OF THE DRAWINGS

DETAILED DESCRIPTION OF THE PREFERRED EMBODIMENTS

Figure 1:
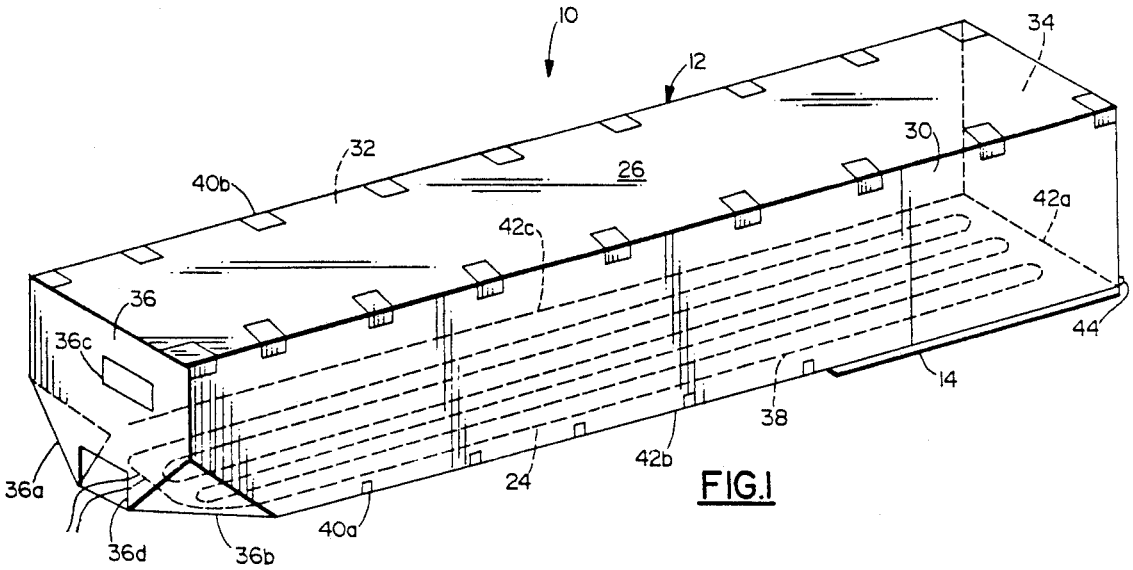
FIG. 1 is an orthogonal view of a container liner according to the present invention.
Figure 2:
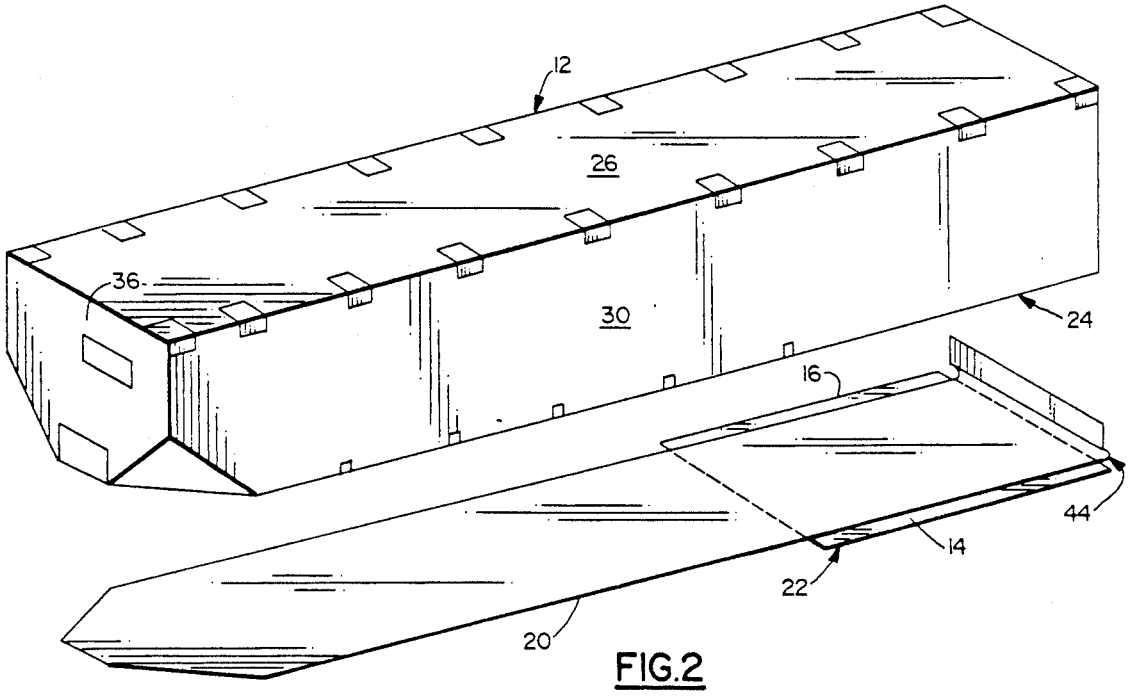
FIG. 2 is similar to FIG. 1 but shows several panels of the liner separated from the liner body.
Figure 3:
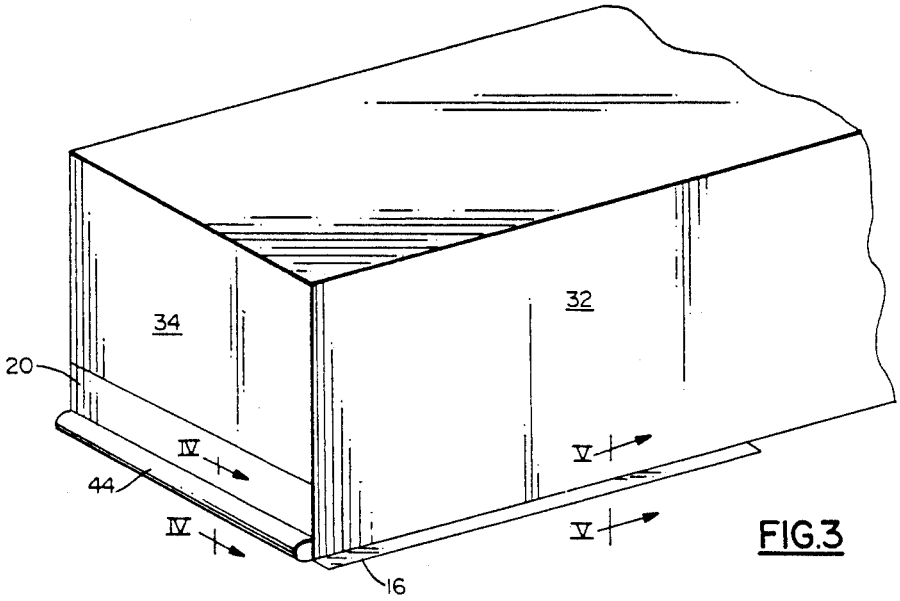
FIG. 3 is an orthogonal view of a front portion of the liner.

FIGS. 1–3 illustrate an expandable and flexible liner 10 comprising liner body 12, and left and right connecting strips 14 and 16. Preferably, liner 10 further comprises reinforcing panel 20 and connecting panel 22, which forms the connecting strips 14 and 16. Liner body 12, in turn, includes bottom and top panels 24 and 26, left and right side panels 30 and 32, and front and back panels 34 and 36, which are connected or formed together to form the liner body. Liner 10 is employed to line the interior of a cargo container; and when the liner is inflated or expanded inside the container, the shape of the liner partially or substantially conforms to the shape formed by the interior surfaces of that container. As illustrated in FIG. 1, liner body 12 has a hollow, substantially parallelpiped shape. Liner 10 is designed to conform substantially to the shape of the interior of the cargo container with which the liner is used. It should be noted, however, that the present invention may be practiced with liners that only partially conform to the shape of the interior of the cargo container with which the liner is used. For example, many liners are only half the height of the cargo containers with which they are used, and the present invention may also be employed with such liners.

Once liner 10 is positioned inside the cargo container, a bulkhead (not shown) is preferably held or positioned against back panel 36 to help support that panel. Any suitable bulkhead may be employed with liner 10, and one such bulkhead is disclosed in detail in U.S. Pat. No. 4,799,607. To accommodate this bulkhead, back panel 36 has left and right triangular shaped corner portions that form lower right and left back truncated corners 36*a* and *b*. Inlet and outlet openings 36*c* and *d* are provided in back panel 36 to conduct cargo into and out of liner 10, respectively; and these openings may be normally covered by flaps or other closure members. Chutes (not shown) may be connected to back panel 36, adjacent openings 36c and *d*, to facilitate loading cargo into or unloading cargo from the liner 10.

An element 38, such as an electric heating ribbon, wire, rope or pipe element may be placed inside or outside of liner 10 to keep product warm inside the liner during transportation, or to liquify product for discharging. For example, this heating element may be used to allow semi-liquid products to be loaded into and discharged from a liner, even though those products may normally have a low viscosity and normally do not flow easily, or the products solidify when cooled such as syrup, chocolate liquor, tallow, hot melt adhesives, waxes, lard and others. It should be noted that element 38 does not have to be an electric heating element; and, for instance, hot or cooled liquids may be conducted through tubes placed in liner 10 or in a cargo container, with circulation methods, from heated or cooled tanks to heat or cool, respectively, the contents of the liner if desired.

To help secure liner 10 inside a cargo container, a first set of connecting members 40*a* are positioned around the bottom of liner body 12, and a second set of connecting members 40*b* are positioned around the top of the liner body. Additional connecting members (not shown) may be positioned on other edges or surfaces of liner body 12. Any suitable connecting members may be used with liner 10; and for example, each connecting member may be made from a reinforced woven plastic material and heat sealed to liner body 12 and each connecting member may have one or more apertures that receive a rope used to connect the liner to a hook secured to an inside surface of a cargo container. Suitable connecting members are disclosed in copending application serial no. filed herewith for "A Liner For A Cargo Container," the disclosure of which is herein incorporated by reference.

Liner body 12 may be made in any suitable manner and from any suitable material, and for example, the liner body may be made from a thin plastic material such as polyethylene having a thickness of 7 mils. Liner body 12 may be formed from one large sheet of plastic material and folded into the desired shape. Alternatively, panels 24, 26, 30, 32 and 34 may be formed from one large sheet of material and folded into the desired shape, with back panel 36 subsequently connected to panels 24, 26, 30 and 32 to form the complete liner body. As still another example, each panel of liner body 12 may be formed separately, and the panels may be connected together to form the desired liner body. Preferably, any suitable technique may be employed to make any necessary connections between the panels of the liner body; and for instance, liner body panels may be heat sealed together, or sewn or glued together.

Reinforcing panel 20 is secured to the bottom panel 24 of liner body 10 to reinforce the latter panel, and preferably the reinforcing panel extends under and is connected to the bottom surface of bottom panel 24.

Reinforcing panel 20 extends rearward from, or from a position adjacent, the front edge 42*a* of the liner, and preferably this reinforcing panel extends rearward over the complete length of bottom panel 24.

Figure 4:
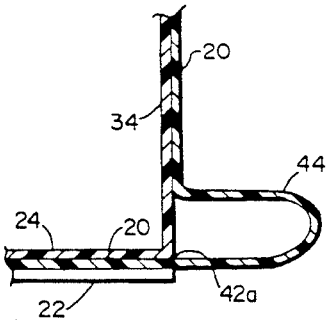
FIG. 4 is a cross-sectional view showing a front sleeve or loop of the liner, and taken along line IV—IV of FIG. 3.
Figure 5:
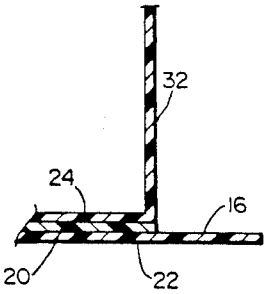
FIG. 5 is a cross-sectional view showing the right connecting strip of the liner and taken along line V—V of FIG. 3.

Reinforcing panel 20 may also be secured to a bottom portion of front panel 34 of liner body 12 to reinforce this area of the latter panel; and as shown in the drawings, reinforcing panel 20 extends upward approximately 25 percent of the height of panel 34. Reinforcing panel 20 may extend to a higher or lower height; and, if desired, the reinforcing panel may completely cover front liner panel 34. With particular reference to FIG. 4, a portion of reinforcing panel 20 extends around front liner edge 42*a* and, in combination with front panel 34, forms a sleeve or loop 44, that in use, receives a wooden slat or similar device that is used to nail the liner to the floor of a cargo container.

Reinforcing panel 20 also may be made from any suitable material and in any suitable manner, and connected to liner body 12 in any suitable way. Preferably, in liner 10, panel 20 has a high resistance to stretching at least along the length of the liner. For example, the reinforcing panel 20 may be constructed of woven polyethylene and polypropylene fabric also having a thickness of about 7 mils. Alternatively, the reinforcing panel could be made from strips, such as 2 inch strips, of fiberglass tapes, metal reinforced tapes or polyester reinforced tapes, or the reinforcing panel could be made from coextruded cross-laminated plastic film, or coextruded, or cross laminated film.

The use of reinforcing panel 20 is not necessary to the practice of the present invention in its broadcast sense, and it may be possible to provide liner 10 with the desired longitudinal strength by forming the whole liner body 12 from a high strength material that would provide the desired resistance to stretching. Using the reinforcing panel 20 is preferred, however, because this is a very simple, economical and effective way to provide liner 10 with the desired longitudinal strength.

In the inflated or operating position of liner 10, shown in FIGS. 1 through 3, bottom and left side panels 24 and 30 form a bottom left edge 42*b*, and bottom and right side panels 24 and 32 form a bottom right edge 42*c*. Left connecting strip 14 extends along and laterally projects outside the bottom left edge 42*b*, and right connecting strip 16 extends along and laterally projects outside the bottom right edge 42*c*. Each of these connecting strips 14 and 16 extends rearward from, or from a position adjacent, the front edge 42*a* of the liner 10; and preferably each of these strips extends rearward for a distance equal to at least about 20 percent of the length of the liner. The connecting strips 14 and 16 may extend even further forward if desired; and, for instance, the connecting strips may extend along the entire length of the liner body 12.

Left and right connecting strips 14 and 16 may be made or formed in various ways. As particularly illustrated in FIG. 2, connecting strips 14 and 16 may be formed by connecting panel 22. More specifically, connecting panel 22 extends completely across and laterally projects outside of liner body 12 with left and right lateral extensions of the connecting panel forming connecting strips 14 and 16 respectively. Connecting panel 22 may be made from the same material or materials used to make liner body 12, and the connecting panel may be secured to reinforcing panel 20 or to the liner body in any suitable manner.

Figure 6:
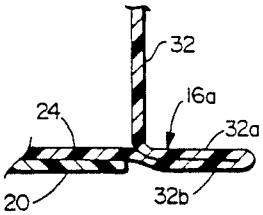
FIG. 6 is a cross-sectional view showing an alternate connecting strip that may be used with the liner of FIG. 1.

With an alternate arrangement illustrated in FIG. 6, right connecting strip 16*a* may be formed by holding or folding a first lower longitudinally extending portion 32*a* of side panel 32 against a second lower longitudinally extending portion 32*b* of that same side panel; and analogously, left connecting strip 14 may be formed by holding or folding a first lower longitudinally extending portion of side panel 30 against a second lower longitudinally extending portion of that side panel 30.

Figure 7:
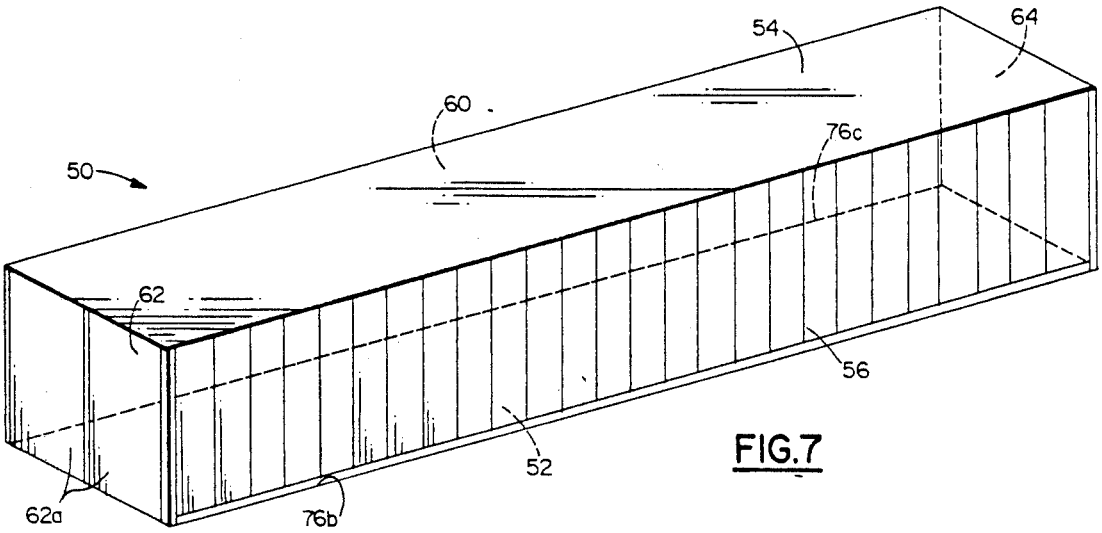
FIG. 7 shows a container with which the liner may be used.

Liner 10 may be used with any suitable cargo container; and, for example, FIG. 7 illustrates a container 50 with which the liner may be used. This container has a conventional size and shape, and in particular, includes a container body having floor and roof 52 and 54, left and right side walls 56 and 60, and back and front walls 62 and 64. Back wall includes a pair of outwardly hinged doors 62*a* which provide access to the interior of the container.

Generally, in the inflated position of liner 10, bottom panel 24 of the liner extends over the floor 52 of container 50, left and right side liner panels 30 and 32 respectively extend over left and right side walls 56 and 60 of the container, and front panel 34 extends over container front wall 64.

Figure 8:
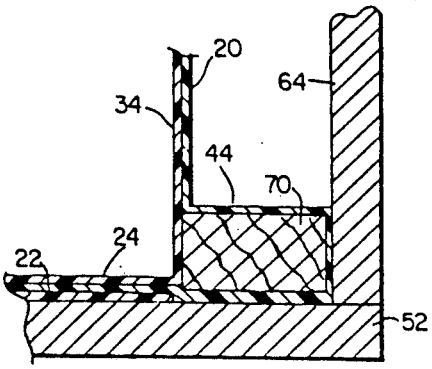
FIG 8 is a cross-sectional view showing how the front sleeve of the liner of FIG. 1 may be connected to the container of FIG. 7.

With reference to FIGS. 8–11, the bottom panel 24 of liner 10, and particularly the front portion thereof, is securely held in place by means of sleeve 44, connecting strips 14, 16 and elongated securing members 70, 72 and 74. With particular reference to FIG. 8, securing member 70 is located inside liner sleeve 44, this sleeve is positioned on the container floor 52, preferably directly against front wall 64 of the container, and the sleeve and securing member 70 are connected to the container floor. Preferably, securing member 70 is a wooden slat, and sleeve 44 and slat 70 are simply nailed to the container floor.

Figure 9:
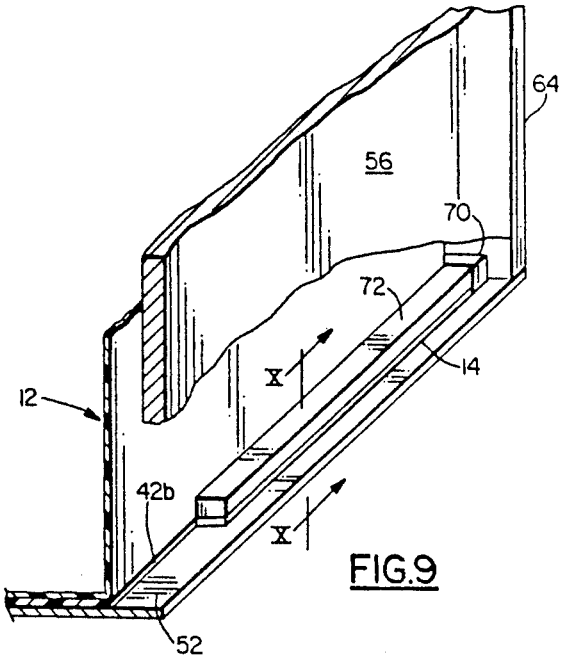
FIG. 9 shows a left front portion of the liner inside the cargo container.
Figure 10:
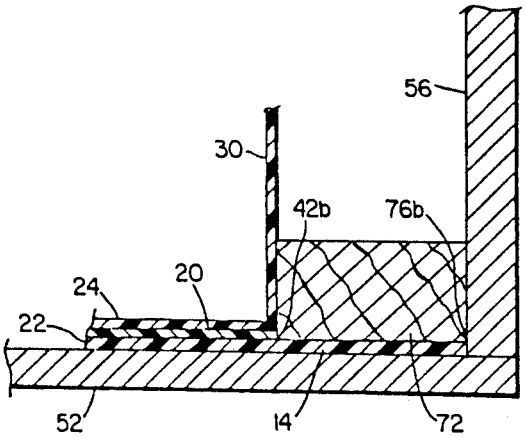
FIG. 10 is a cross-sectional view taken along line X—X of FIG. 9.

With particular reference to FIGS. 9 and 10, left connecting strip 14 is positioned on container floor 52, between the bottom left edge 42*b* of the liner and the left bottom interior edge 76*b* of the container 50, which is formed by container floor 52 and left side wall 56. Left elongated securing strip 72 extends forward, over the left side connecting strip 14, from the back edge 42*a*, or from a position adjacent the back edge 42*a*, of the liner body 12, and releasably clamps that left connecting strip to the container floor. Similarly, with particular reference to FIG. 11, right connecting strip 16 is positioned on container floor 52, between the right bottom edge 42*c* of liner 10 and the right bottom interior edge 76*c* of the container, which is formed by container floor 52 and right side wall 60. Right elongated securing strip 74 extends forward, over right connecting strip 16, from the back edge 42*a*, or from a position adjacent the back edge, of the liner body 12, and releasably clamps that right connecting strip to the container floor.

Preferably, each of the securing members 72 and 74 is a wooden slat, and each of these slats is nailed to container floor 52, directly over strips 14 and 16 respectively. Securing members 70, 72 and 74 may be secured in place in other ways, and for instance, these securing members may be screwed or stapled to the container floor 52. Nailing is preferred, however, because it can be done very easily and inexpensively, and because the nails can, likewise, be removed from the securing members quickly and easily. Moreover, securing members 70, 72 and 74 themselves may be made of other material. For example, these securing members 70, 72 and 74 may be formed from a plastic or metal and provided with appropriate openings or through holes to receive nails or screws to connect the securing members to container floor 52.

The specific lengths of securing members 72 and 74 may vary over a wide range. It is believed that the preferred lengths of these securing members is between about 20% and about 50% of the length of liner 10; and that for most applications, excellent results can be obtained with securing members that are between about 20% and 25% of the length of the liner. For example, with a forty foot long liner, securing members 72 and 74 are preferably eight to ten feet long. Longer securing members 72 and 74 may be used, and if desired, these securing members could extend along the whole length of the liner 10.

With the arrangement illustrated in FIGS. 8–11, slat 70 abuts against container front wall 64, slat 72 abuts against container left side wall 56, and slat 74 abuts against container right side wall 60. Moreover, slat 70 laterally extends substantially completely across the interior of the cargo container, and the front ends of both slats 72 and 74 abut against the front lateral slat 70.

Figure 12:
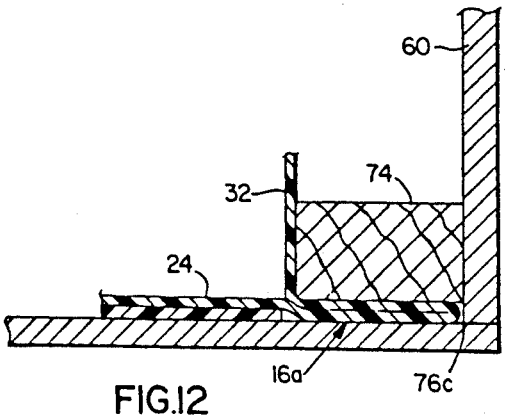
FIG. 12 illustrates how the alternate connecting strip of FIG. 6 may be secured in the container of FIG. 7.

With reference to FIG. 12, the connecting strip 16*a* of FIG. 6 may be connected to the container floor in a manner identical to the way in which strip 16 is connected thereto. In particular, this may be done by placing securing member 74 over that strip 16*a* and then nailing the member 74 to the container floor 52.

To install liner 10 inside a cargo container 50, the liner is placed inside the container, with bottom panel 24 on or over container floor 52 and with liner edges 42*b* and *c* adjacent container edges 76*b* and *c* respectively. Liner 10 may be in a collapsed, comparatively flat condition when it is placed in the container, with top panel 26 lying closely over bottom panel 24, and with side panels 30 and 32 folded inward between the top and bottom panels. The liner 10 may be placed in the container in a further folded or rolled condition, and then unfolded or unrolled into the above-mentioned comparatively flat condition.

Securing member 70 is inserted into sleeve 44 and secured to container floor 52, preferably in the position shown in FIG. 8, with the sleeve abutting against container front wall 64 and with securing member 70 extending substantially completely across the container. Left connecting strip 14 is positioned between the bottom left edge 42*b* of the liner and the lower left edge 76*b* of the cargo container, and releasably clamped to container floor 52 by securing member 72; and right connecting strip 16 is positioned between bottom right edge 42*c* of the liner and lower right edge 76*c* of the cargo container, and releasably clamped to container floor 52 by securing member 74. Then, connecting members 40*a* may be connected to various hooks or similar devices spaced around the bottom of container 50.

After securing members 70, 72 and 74 are securely installed, liner 10 is partially inflated or expanded, for example by conducting a gas into the interior of the liner via inlet 36*c*, and then top connecting members 40*b* are secured to hooks spaced around the roof or the top of the walls of container 50. After this, liner 10 may be fully inflated or expanded, and a bulkhead may be installed in cargo container 50, against the back panel 36 of the liner. Further, bracing may be provided to support the back panel of the liner.

Figure 13:
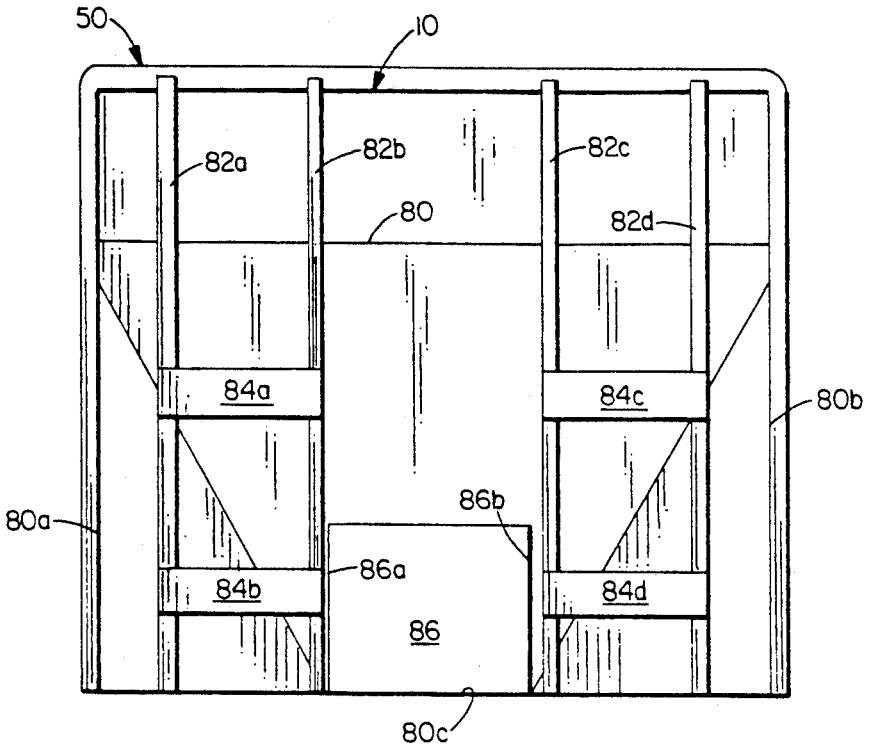
FIG. 13 shows a bulkhead, and a bracing system for the bulkhead, to support the liner in a cargo container.
Figure 14:
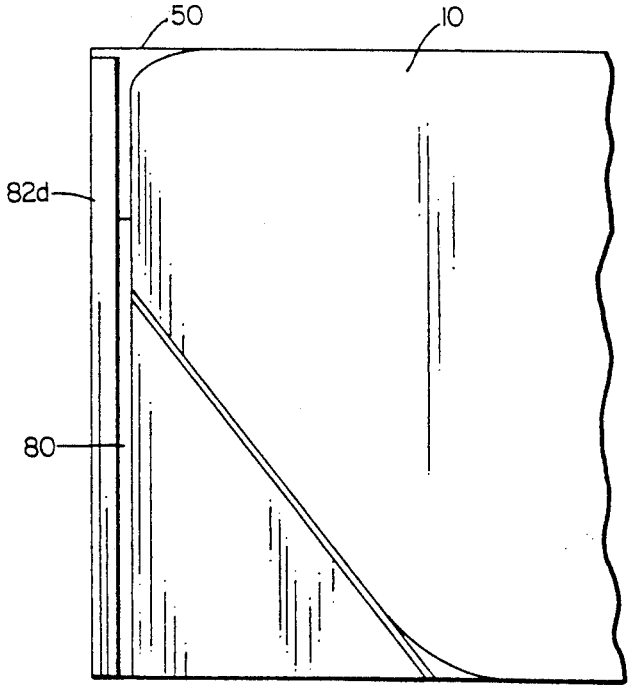
FIG. 14 is a side view of the bulkhead and bracing system of FIG. 13.

For example, FIGS. 13 and 14 illustrate one very effective and reliable, yet very inexpensive, arrangement for bracing such a bulkhead, generally referenced at 80. This bracing system comprises vertical beams 82*a–d* and cross beams 84*a–d*. Each of vertical beams 82*a–d* is securely connected to container floor 52 and these beams are spaced apart along the width of bulkhead 80 and extend upward thereagainst to brace the bulkhead in container 50. Each of the beams 82*a–d* extends upward for at least a substantial portion of the height of bulkhead 80; and with the embodiment shown in the drawings, the length of each of the beams 82*a–d* is just slightly less than the inside height of container 50.

With particular reference to FIG. 13, bulkhead 80 includes an outlet opening 86 that is centrally located along a bottom portion of the bulkhead and that, in use, is aligned with outlet 36*d* of liner 10 to conduct cargo outward from the interior thereof. Vertical beam 82*b* is laterally disposed slightly to the left of the left edge 86*a* of outlet opening 86, and beam 82*a* is laterally disposed between beam 82*b* and the left edge 80*a* of bulkhead 80. Analogously, beam 82*c* is laterally disposed slightly to the right of the right edge 86*b* of outlet opening 86, and beam 82*d* is laterally disposed between beam 82*c* and the right edge 80*b* of bulkhead 80. With the specific arrangement shown in the drawings, beam 82*b* is spaced from the left edge 80*a* of bulkhead 80 a distance equal to about one-third of the width of the bulkhead, and beam 82*a* is spaced to the left of beam 82*b* a distance equal to about two thirds of the distance between that latter beam 82*b* and the left edge 80*a* of the bulkhead. Similarly, beam 82*c* is spaced from the right edge 80*b* of bulkhead 80 a distance equal to about one-third of the width of the bulkhead, and beam 82*d* is spaced to the right of beam 82*c* a distance equal to about two-thirds of the distance between that beam 82*c* and the right edge 80*b* of the bulkhead.

Cross beams 84*a* and *b* are connected to beams 82*a* and *b* to help hold these latter beams upright, and preferably beams 84*a* and *b* are parallel to each other. Cross beams 84*c* and *d* are connected to beams 82*c* and *d* to help hold these latter beams upright, and preferably beams 84*c* and *d* are parallel to each other. Beams 82*a–d* and beams 84*a–d* can be constructed in modular form sets to save time and labor costs.

Preferably beams 84*a–d* are horizontal, although, alternatively, they may be at an angle to the horizontal. As shown in FIG. 13, beam 84*a* is connected to beams 82*a* and *b* about halfway along the height of these beams, and beam 84*b* is connected to beams 82*a* and *b* at about one-third of the distance from bottom edge 80*c* of bulkhead 80 to beam 84*a*. Likewise, beam 84*c* is connected to beams 82*c* and *d* about halfway along the height of those beams, and beam 84*d* is connected to beams 82*c* and *d* at about one-third of the distance from bottom edge 80*c* of bulkhead 80 to beam 84*c*.

Figure 15:
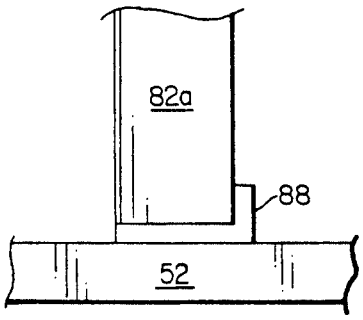
FIG. 15 illustrates how one of the beams of the bracing system of FIGS. 13 and 14 may be connected to the floor of a cargo container.

Beams 82*a–d* and 84*a–d* may be made of any suitable materials, although preferably they are all wood beams. With the particular arrangement shown in the drawings, each of the vertical beams 82*a–d* has nominal dimensions of two inches by two inches by eight feet, and each of the cross beams 84*a–d* has nominal dimensions of one inch by six inches by twenty-one inches. The preferred dimensions of beams 82*a–d* and 84*a–d* may be different, though, depending on the height and width of the cargo container with which the beams are used. Cross beams 84*a–d* may be connected to vertical beams 82*a–d* in any suitable manner, although preferably these beams are pre-assembled and nailed together. Likewise, vertical beams 82*a–d* may be connected to container floor 52 in any acceptable way; and, for instance, a multitude of angle irons, one of which is shown at 88 in FIG. 15, may be nailed or screwed to container floor 52 and to beams 82*a–d* to connect those beams to the container floor.

Figure 16:
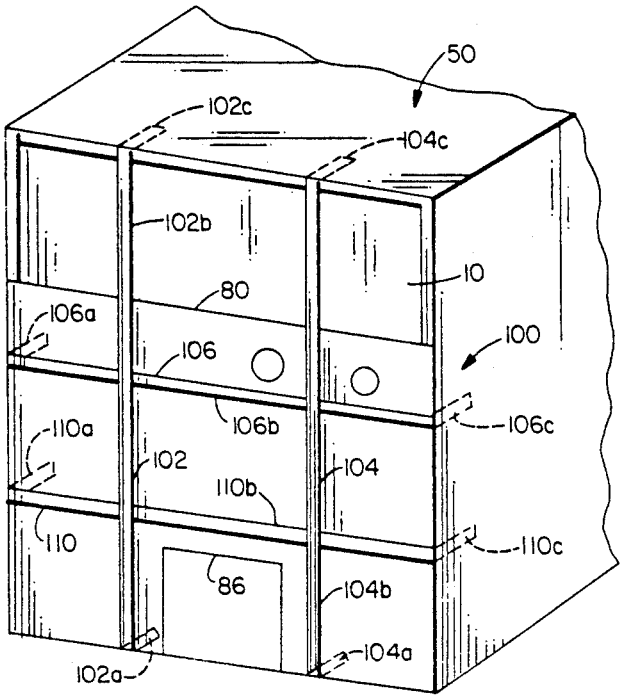
FIG. 16 shows an alternate system for bracing a bulkhead in a cargo container.

FIG. 16 illustrates an alternate means, generally referenced at 100, for bracing bulkhead 80 in container 50, and in which flexible straps, which may be made of metal or non-metal materials, are substituted for the wood beams shown in FIG. 14, eliminating the need and the cost of those wood beams. Bracing means 100 includes a plurality of generally vertical, upwardly extending straps 102 and 104, and a plurality of laterally extending straps 106 and 110. Straps 102 and 104 are connected to and extend between the floor and the ceiling of the body of container 50, and are held against bulkhead 80; and straps 106 and 110 are connected to and extend between the left and right side walls of the container body, and also are held against the bulkhead. More specifically, each of the upwardly extending straps 102 and 104 includes a bottom portion, a top portion and a main portion; and in FIG. 16, the bottom, top and main portions of strap 102 are referenced as 102*a, b* and *c* respectively, and the bottom, top and main portions of strap 104 are referenced as 104*a, b* and *c* respectively. The bottom portion of each strap 102, 104 horizontally extends along and is connected to the floor of the container body, the top portion of each of these straps horizontally extends along and is connected to the ceiling of the container body, and the main portion of each strap 102, 104 is connected to and extends between the bottom and top portions of the strap and is held against bulkhead 80.

Each of the laterally extending straps 106, 110 includes a left portion, a right portion, and a main portion; and in FIG. 16, the left, right and main portions of strap 106 are referenced at 106*a, b* and *c* respectively, and the left, right and main portions of strap 110 are referenced at 110*a, b* and *c* respectively. The left portion of each lateral strap extends against and is connected to the left side wall of container 50, the right portion of each lateral strap extends against and is connected to the right side wall of the container, and the main portion of each lateral strap is connected to and extends between the left and right connecting portions of the strap, and is held against bulkhead 80.

The straps used in bracing means 100 may be made of any suitable material; and for instance, the straps may be made of a flexible, high strength metal. Alternatively, these straps may be constructed of woven polyethylene and polypropylene, or the straps may be made from strips, such as 2" strips, of fiberglass tapes, metal reinforced tapes or polyester reinforced tapes. As still additional examples, the brasing straps could be made from coextruded cross-laminated plastic film, or co-extruded, or cross-laminated film. Typically, metal straps are preferred because they can be made with a relative high resistance to stretching. Metal straps of various width and thicknesses may be used in bracing system 100; and for instance, the width of the straps may be between $\frac{3}{4}$" and 3" or 4", the thicknesses of the straps may be between 20 and 80 mills, and each strap may have a break strength of between 2,000 and 60,000 pounds.

Figure 17:
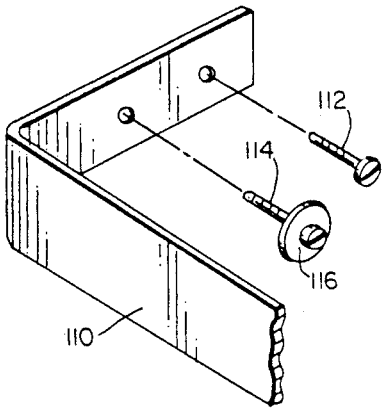
FIGS. 17 and 18 illustrate various arrangements for connecting strips of the bracing system of FIG. 16, to a sidewall of the cargo container.

The straps of bracing means 100 may be connected to the body of container 50 in any acceptable manner; and as an example, and with reference to FIG. 17, screws 112 and 14 may be used to secure strap 110 to the container body. To allow this, the strap and the container body are provided with suitable openings to receive those screws. These openings may be formed in the container body and the bracing straps before the straps are positioned against the container body, or self tapping screws may be used to form those openings as the bracing straps are screwed to the container body. Washers, such as washer 116 may be disposed between the bracing straps and the heads of the screws used to connect those straps to the container body. As will be understood by those of ordinary skill in the art, the straps of bracing means 100 may be secured in place in other ways; and, for example, depending on the material from which the straps are made and the specific material to which the straps are secured, the straps may be nailed, stapled, welded or bolted in place.

Figure 18:
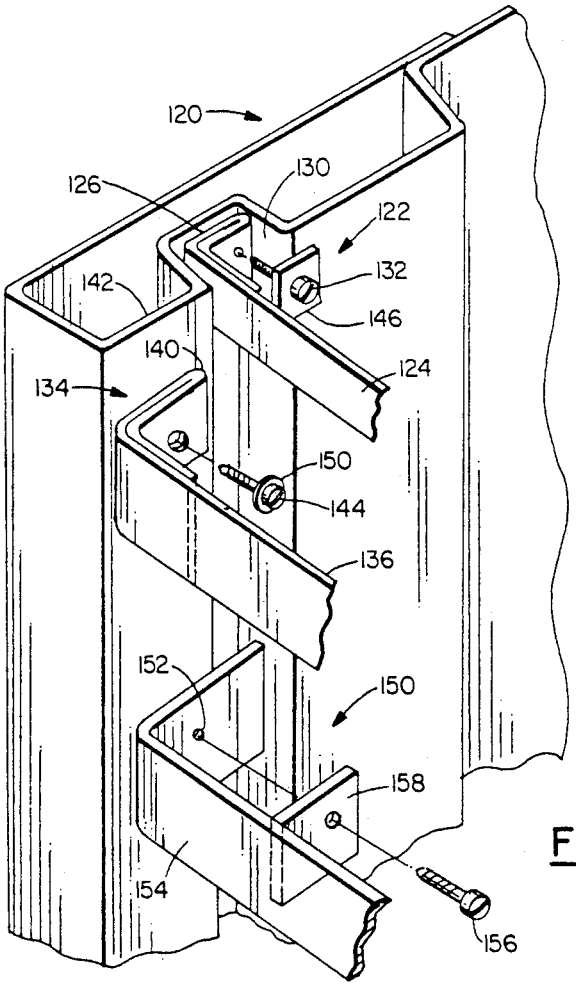

FIG. 18 illustrates three alternate ways for connecting a strap to a container body, specifically a side wall 120 thereof. With the arrangement shown at 122, an end portion of strap 124 is folded over and against itself, forming a double thickness section 126; and a portion of this section 126 is held against the container side wall, inside a vertical groove 130, and a self tapping screw 132 is threaded through this double thickness section and into the container side wall, connecting the strap thereto. Similarly, with the arrangement shown at 134, an end portion of strap 136 is folded over and against itself, forming double thickness section 140; and a portion of this section 140 is held against the container side wall, specifically surface 142 thereof, and a self tapping screw 144 is threaded through this double thickness section and into the container side wall, connecting the strap thereto.

With both of the procedures discussed immediately above, as the self tapping screw is threaded through the bracing strap and into the container side wall, that screw forms aligned openings in the strap and the container side wall. Also, washers, such as square washer 146 or round washer 150, may be disposed between the bracing strap and the head of a screw used to connect the strap to the container side wall.

The double thickness sections 126 and 140 of straps 124 and 136 respectively, provide additional strength to prevent the screws 132 and 144 from tearing the bracing straps. As indicated above, preferably double thickness sections 126 and 140 are formed by folding over end portions of straps 124 and 136 respectively. Double thickness sections may be formed in other ways; and, for example, a separate piece of material may be placed over and secured to an end portion of a strap to form a section having a double thickness.

With the connecting arrangement shown at 150, an opening (not shown) is formed in the container side wall, and a through hole 152 is formed in an end portion of strap 194. Strap 154 is placed against the container side wall with these two openings aligned, and a screw 156 is threaded through these two openings to connect the strap to the container side wall. A washer 158 may be positioned between the end portion of strap 154 and the head of screw 156.

Bracing means 100 may include any suitable number of upwardly extending straps and any suitable number of laterally extending straps, and these straps may be arranged in various patterns. The preferred number and pattern of the bracing straps depends in part on the specific bulkhead with which the straps are used, and more specifically, on the location of the inlet and discharge openings in that bulkhead. For instance, with the bulkhead 80 shown in FIG. 16, and which includes a central bottom discharge opening 86, strap 102 extends upwards, substantially vertically, adjacent and laterally to the left of the left edge of the discharge opening, and strap 104 extends upward, substantially vertically, adjacent and laterally to the right of the right edge of the discharge opening. Moreover, as shown in FIG. 16, lateral straps 106 and 110 are substantially horizontal; however, this is not necessary and instead these straps may extends across bulkhead 80 at an acute angle to the horizontal, either parallel to each other, or forming an x across the bulkhead.

Figure 19:
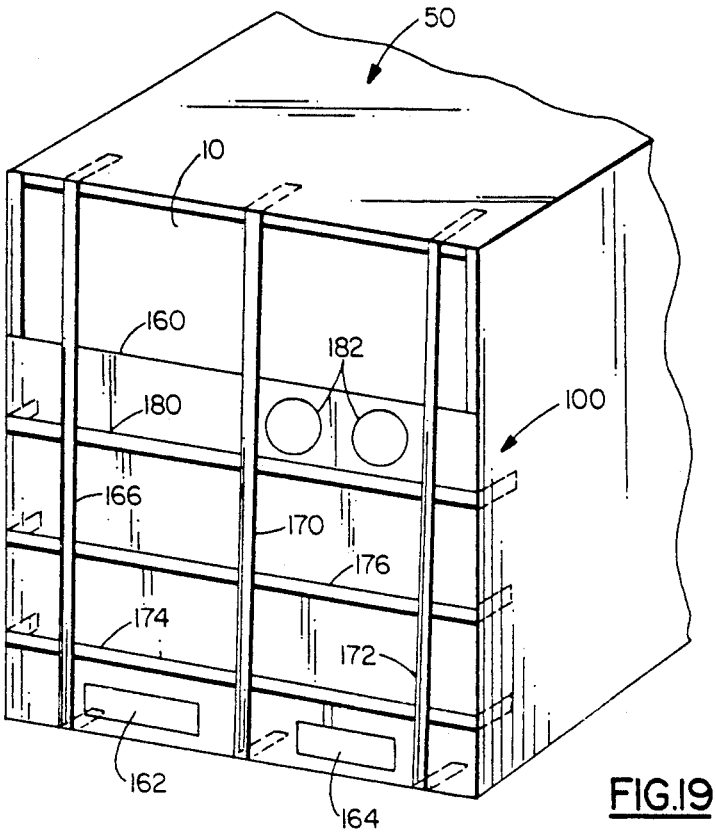
FIGS. 19 and 20 show additional systems for bracing a bulkhead in a cargo container.

FIG. 19 shows a cargo container 50 having an alternate bulkhead 160 having two lower discharge openings 162 and 164. The embodiment of bracing means 100 used with this bulkhead includes three upwardly extending straps 166, 170 and 172, and three laterally extending straps 174, 176 and 180. Strap 166 extends upwards, substantially vertically and laterally to the left of the left discharge opening 162; strap 170 extends upwards, substantially vertically and laterally between the discharge openings 162 and 164; and strap 170 extends upwards, substantially vertically and laterally to the right of the right discharge opening 154. Strap 176 extends horizontally across the bulkhead, generally midway between the top and bottom edges of the bulkhead; strap 174 extends horizontally, slightly above the top edges of the discharge openings; and strap 180 extends horizontally slightly below the bottom edge of inlet openings 182.

Figure 20:
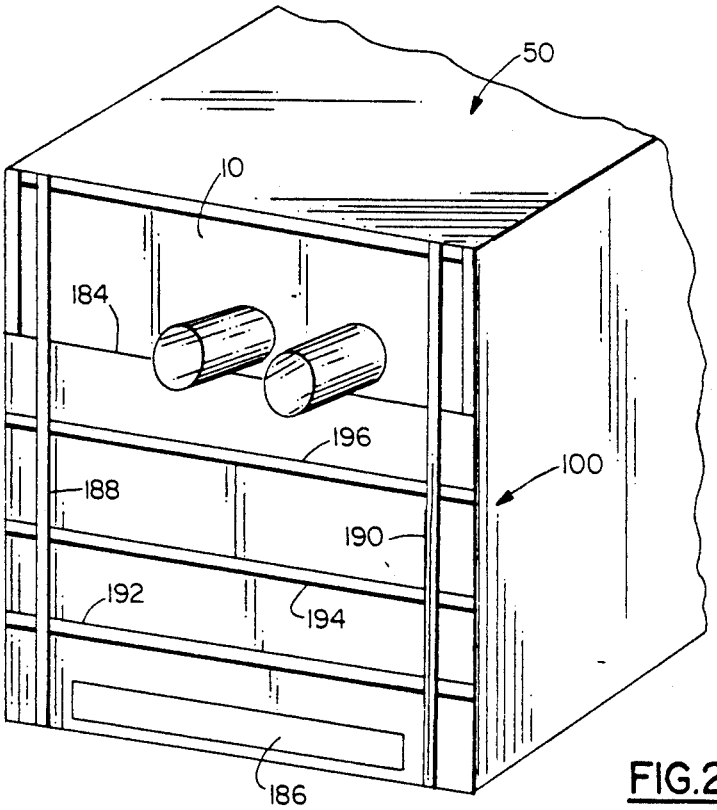

FIG. 20 shows cargo container 50 having a third bulkhead 184 that forms a comparatively wide discharge outlet 186. The embodiment of bracing means 100 used with this bulkhead includes first and second upwardly extending straps 188 and 190, and first, second and third lateral straps 192, 194 and 196. Strap 188 extends upwards, laterally between the left edge of the bulkhead and the left edge of opening 186; and strap 190 extends upwards, laterally between the right edge of the bulkhead and the right edge of opening 186. Straps 192, 194 and 196 horizontally extend across the bulkhead and are vertically spaced apart a distance about $\frac{1}{4}$ the height of the bulkhead itself.

Bracing means 100 maintains a bulkhead in position inside cargo container 50, and allows the bulkhead to withstand the pressure of the commodity inside the liner 10 even when the cargo container is tilted to angles of from 25° to 75° to discharge the cargo from the liner. Bracing means 100 is simple to use, economical and very effective. The desired bracing straps may be connected to the container body by self tapping drill screws or pre-drilling suitable holes in the straps and the container body, and then using screws or bolts to connect the straps to the container body. Further, if steel bracing straps are used, these straps may be securely connected to the container body by means of self tapping drill screws, eliminating the need to pre-form any holes in the straps or in the container body.

Figure 21:
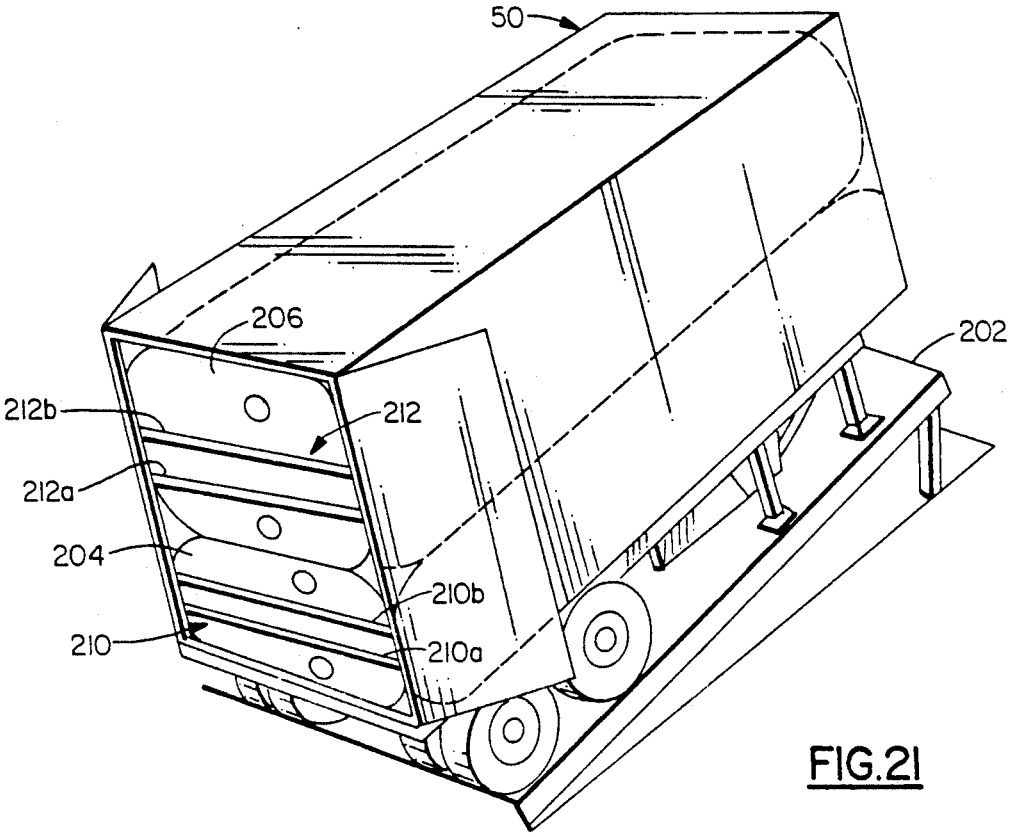
FIGS. 21 to 24 show bracing systems that may be used with or without bulkheads, to brace one or more flexible liners in a cargo container.
Figure 22:
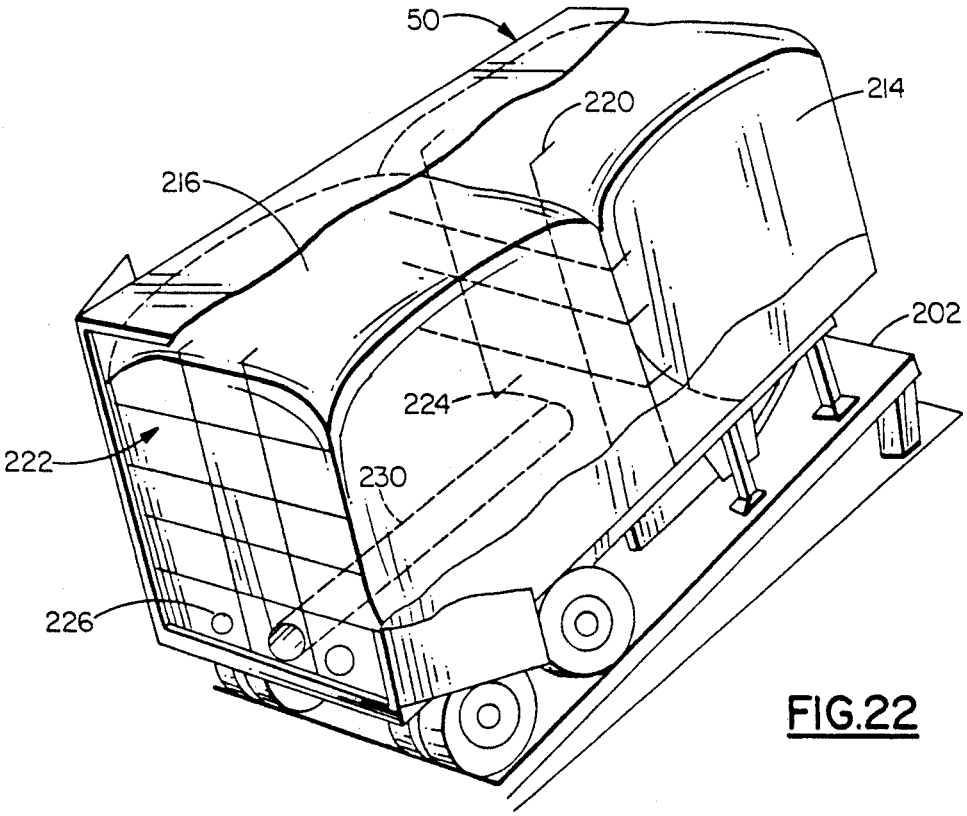
Figure 23:
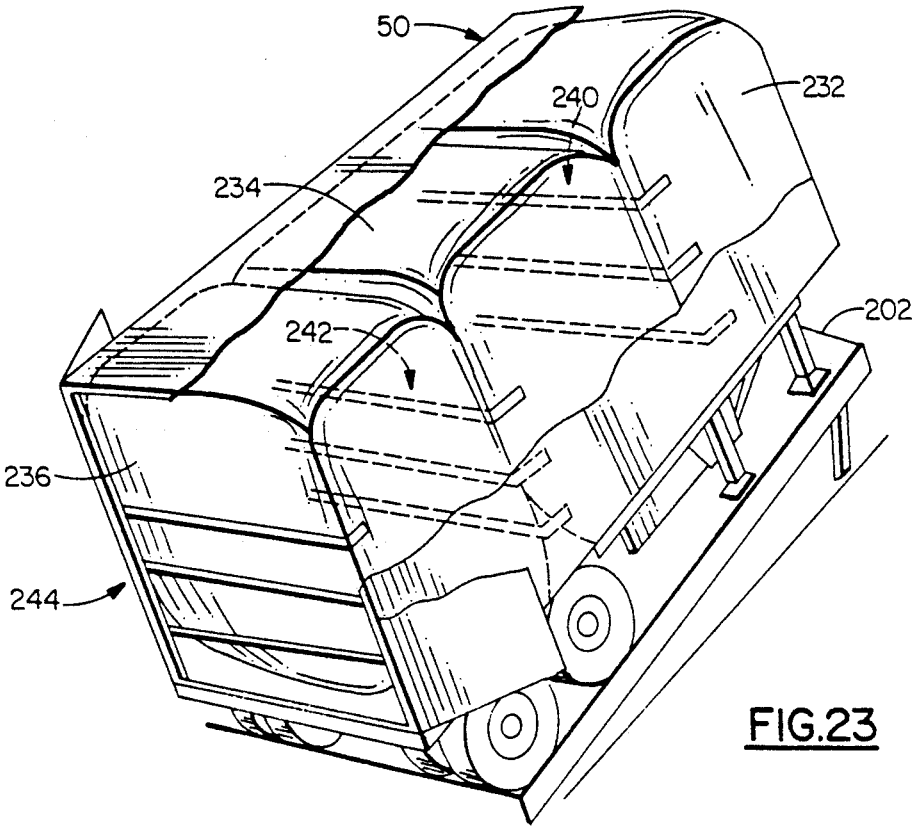

Indeed, bracing means 100 works so effectively that the bracing means may, under some circumstances, eliminate the need for a bulkhead to support a liner inside cargo container 50. This, in turn, increases the number of ways in which a plurality of liners may be held inside the cargo container; and for example, FIGS. 21–24 illustrate four arrangements for positioning and holding a plurality of liners inside cargo container 50. Each of FIGS. 21–23 shows a cargo container 50 including a plurality of flexible and expandable liners secured in the cargo container, and a plurality of modular bracing means, with each bracing means engaging and supporting a respective one of the liners inside the cargo container. FIGS. 21–23 also show the cargo container mounted on a tiltable platform 202 that may be used to tilt the container to unload cargo from the liners inside the cargo container.

FIG. 21 shows cargo container 50 holding two liners 204 and 206, one on top of the other, and including two bracing systems 210 and 212, with each bracing system engaging and helping to support a respective one of the liners. More specifically, liner 204 is positioned on and supported by the floor of the container body, and liner 206 is positioned on an supported by liner 206. Bracing system 210 includes a plurality of straps **210*a* and 210*b* connected to the container body and extending across a back panel of liner 204 to hold the liner inside the container body, and bracing system 212 includes a plurality of straps 212*a* and *b* connected to the container body and extending across a back panel of liner 206** to hold that liner inside the container body.

For example, with the cargo container shown in FIG. 21, liquids may be carried in the bottom liner, and the top liner may carry light weight products such as styrofoam or peanuts in shells. The top liner prevents the bottom liner from surging, by occupying the space inside the cargo container above the bottom liner. Typically, liquid cargo would be discharged from the upper liner before cargo is discharged from the bottom liner.

FIG. 22 shows cargo container 50 holding two liners 214 and 216, one in front of the other, and also including two bracing systems 220 and 222, each of which engages and supports a respective one of the liners. Both of the liners 214 and 216 are positioned on and supported by the floor of the cargo container, and liner 214 is located forward of liner 216. Bracing system 220 includes a plurality of straps connected to the container body and extending, preferably both vertically and horizontally, across a back panel of liner 214 to hold the liner inside the container body; and bracing system 222 includes a plurality of straps connected to the container body and extending, also preferably both vertically and horizontally, across a back panel of liner 216 to hold the liner inside the container body.

Each of the liners 214 and 216 includes a respective discharge outlet 224 and 226 to discharge cargo from the liner; and the cargo container 50 further includes a rigid or flexible discharge conduit or tube 230 to allow cargo to be discharged from liner 214 while liner 216 is still inside the cargo container body, either before or after the latter liner is itself emptied of cargo. Conduit 230 is in communication with discharge outlet 224 of liner 214 and extends forward therefrom, through liner 214, to discharge cargo from the first liner and through the second liner. Conduit 230 may be made, for example, of a metal or solid plastic. Conduit 230 may also be flexible such as a plastic rollout sleeve that can be rolled out to the rear of the container after the rear compartment liner is emptied.

FIG. 23 shows cargo container 50 holding three liners 232, 234 and 236 arranged in series in the container, from the front to the back thereof, and three bracing systems 240, 242 and 244, each of which engages and supports a respective one of the liners inside the cargo container. Each of the liners 232, 234 and 236 are positioned on and supported by the floor of the cargo container; and liner 232 is located in a forward portion of the cargo container, liner 234 is located immediately rearward of liner 232, and liner 236 is located immediately rearward of liner 234. Bracing system 240 includes a plurality of straps connected to the container body and extending across a back panel of liner 232 to hold the liner inside the container body, bracing system 242 includes a plurality of straps connected to the container body and extending across a back panel of liner 234 to hold the liner inside the container body, and bracing system 244 includes a plurality of straps connected to the container body and extending across a back panel of liner 236 to hold that liner inside the container body. Each of the liners 232, 234 and 236 may be provided with closed end caps with threaded fittings, or flexible loading and unloading chutes that can reach the rear of the container so that cargo can be conducted into the liner and subsequently discharged therefrom.

Figure 24:
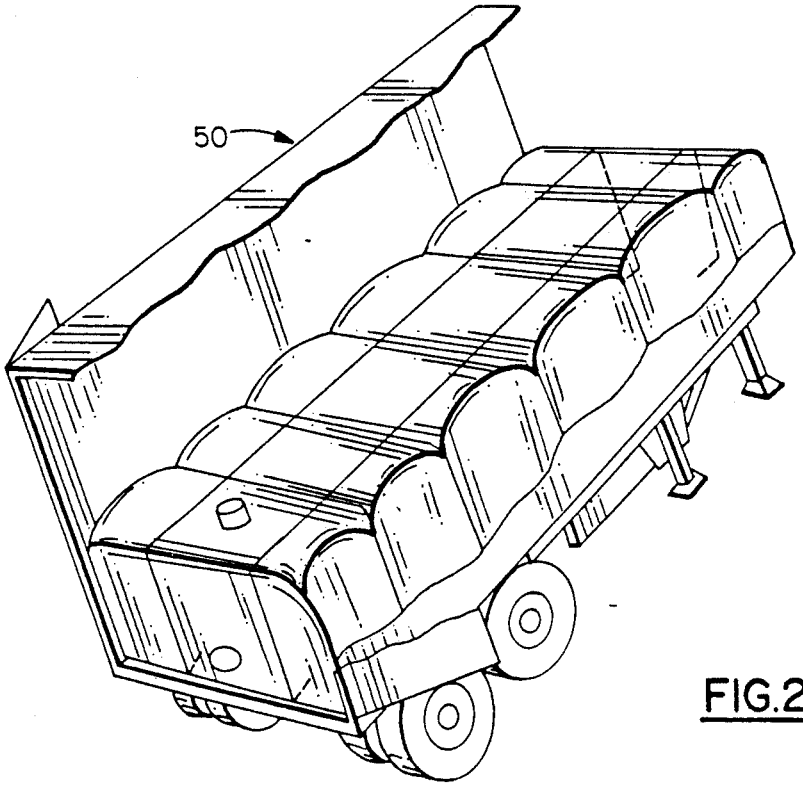

FIG. 24 shows container 50 having liner 250 and bracing system 252. This bracing system is especially well suited for supporting a liner that holds a liquid or semi-liquid because the bracing system inhibits or prevents liquids from surging inside the liner. More specifically, bracing system 252 includes a plurality of longitudinally extending straps 254 and a multitude of transversely extending straps 256. Each of the longitudinal straps is connected to the container floor, beneath a rearward portion of liner 250, and the strap extends upwards against a back panel of the liner and forwards, against the top of the liner, to a front thereof. Each of the longitudinal straps then extends downward, forward of a front panel of the liner and is secured to the container floor, underneath a forward portion of the liner.

Each of the transversely extending straps 256 is connected to the container floor, beneath a right portion of the liner 250, extends upwards along the right side of the liner, and then extends over and against the top of the liner to the left side thereof. Each of the transversely extending straps 256 then extends downward, along the left side of the liner and is connected to the container floor, beneath a left portion of the liner. A filler sprout 260 is connected to the liner, and an unloading spout 262 is connected to the liner to discharge cargo therefrom.

With each of the cargo containers shown in FIGS. 21–24, one or more bulkheads may be used, if desired, to further support one or more of the liners inside the cargo container, or to facilitate loading cargo into or unloading from the liners inside the cargo container. To simplify the illustrations, these bulkheads are not shown in FIGS. 21–24.

Figure 11:
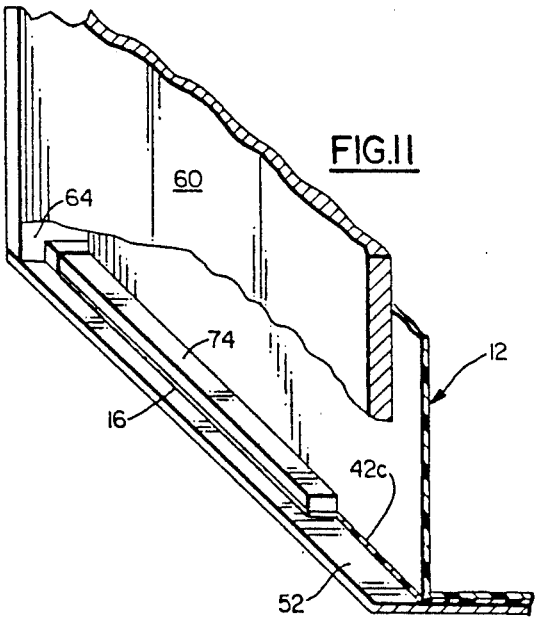
FIG. 11 shows a right front portion of the liner inside the cargo container.

With reference to FIGS. 1 and 11, once liner 10 is fully secured inside container 50, cargo may be loaded into the container, also via inlet 36*c*. To unload the cargo from container 50, outlet 36*d* is opened and the front end of the container is raised so that the cargo slides rearward and out through the opening 36*d* in the back panel 36.

Figure 25:
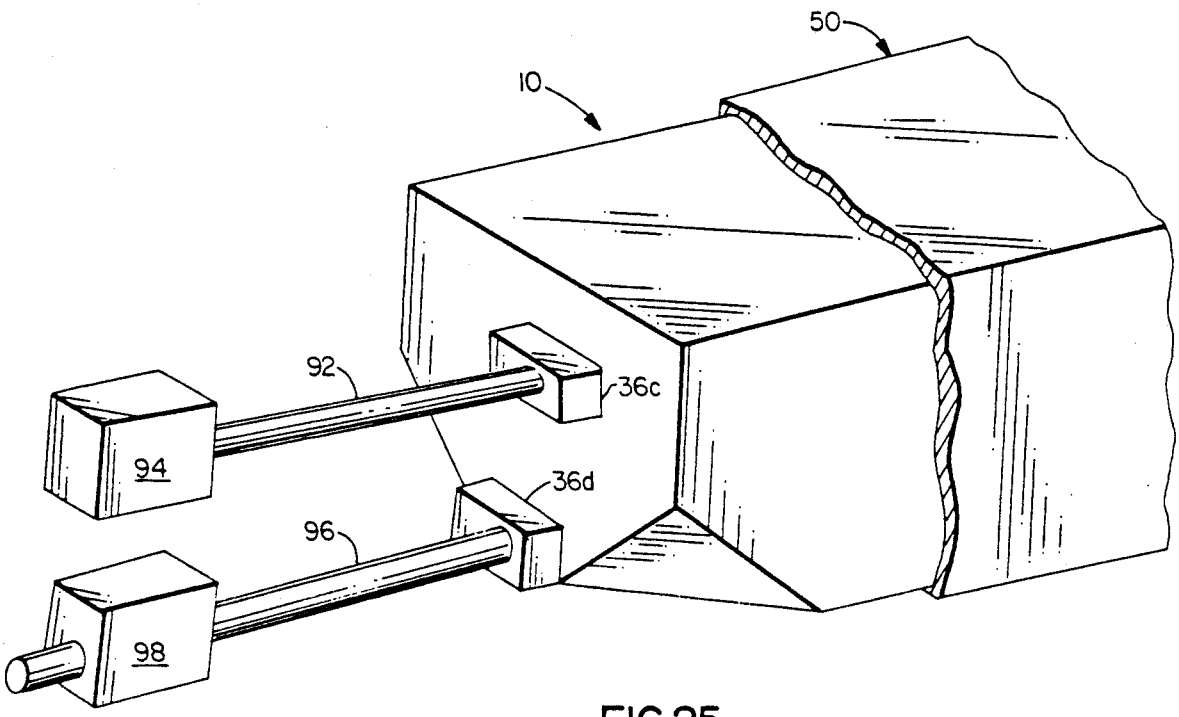
FIG. 25 is a partial perspective view generally depicting a procedure for unloading cargo from a lined cargo container.
Figure 26:
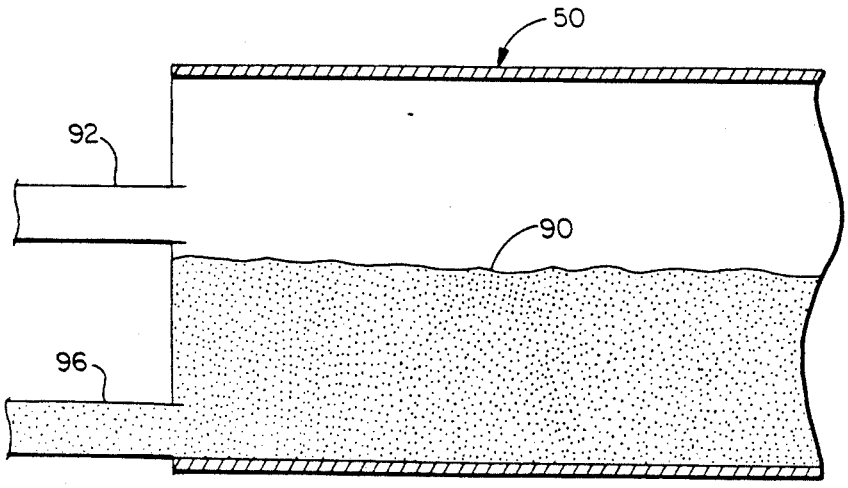
FIG. 26 is a partial sectional view also generally showing cargo being unloaded from the lined cargo container of FIG. 25.

FIG. 25 and 26 generally illustrate an alternate method for discharging cargo from container 50. In accordance with this method, a gas is conducted into liner 10 through inlet port 36*c* to increase the pressure on, in or above the bulk cargo 90 therein, and gas and substantially the complete supply of bulk cargo inside the liner is drawn out therefrom through liner outlet 36*d*, without tilting container 50 or liner 10. It has been found that by creating a suitable disturbance of the bulk cargo inside the liner, that cargo can be fluidized and drawn out through discharge outlet 36*d* without tilting the cargo container or the liner; and moreover, by firmly securing the liner inside the cargo container, as taught hereinabove, the liner is able to withstand the turbulance needed to create the desired fluidized cargo.

More specifically gas supply line 92 is connected to a pressurized gas source, schematically represented at 94 in FIG. 25, which may supply pressurized air or nitrogen for example, and this line 92 is also connected to liner inlet 36*c* via an inlet chute; and discharge line 96 is connected to a low pressure or vacuum source, schematically represented at 98 in FIG. 25, which may be a conventional pump, and this line 96 is also connected to liner outlet 36*d* via an outlet chute. Pressurized air is conducted into liner 10 through hose 92; while gas and product is withdrawn from the liner through hose 96. Preferably, during at least most of the time during which product is withdrawn from the liner, the volume of gas conducted into the liner is about, or substantially at, the same rate of the volume of the gas and cargo withdrawn from the liner; and to help accomplish this, it is desirable to use a supply hose 92 having a diameter that is the same as the diameter of discharge hose 96.

In addition, preferably, during at least most of the time during which cargo is discharged from liner 10, the pressure on the cargo is maintained slightly above the ambiant atmospheric pressure. The air pressure inside the liner is preferably high enough to keep the liner inflated inside container 50, but this pressure should not be allowed to increase to a level where it might damage the cargo container. Pressure sensors, not shown, may be located inside container 50 or liner 10 and connected to pressurized gas source 94 to sense the pressure inside the liner and to deactive the pressurized gas source to stop the flow of gas into the liner when the pressure therein rises above a given level. Further, under some circumstances, especially if the liner 10 is completely filled with cargo, it may be desirable to withdraw some cargo from the liner to develop a space above the cargo therein, before conducting gas or air into the liner via hose 92. Product may be withdrawn, for example, by vacuum from the bottom of the liner 10.

As previously mentioned, prior art container liners often rip or tear as bulk cargo is unloaded from the container. It has been learned that these tears and rips are due, in large part, to the fact that the bottoms of the liners, particularly the front sections thereof, stretch as cargo is carried in and discharged from the liners. In particular, as cargo is unloaded from a liner, the force of the moving cargo over stretched portions of the liner bottom, rips the liner material. In accordance with the preferred embodiment of the present invention, the undesirable stretching of the liner bottom can be prevented, or at least substantially reduced, by tightly securing the liner bottom to the container floor along a significant portion of the front halves of the side, longitudinal edges of the liner as well as the front transverse edge of the liner, in combination with the extra strength provided by the reinforcing panel 20, and the restraint supplied by securing bottom connecting members 40*a* to the container.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. A liner for a cargo container of the type defining an interior cargo space and including at least a floor and left and right side walls, the liner comprising:

an expandable body having an expanded shape adapted to fit inside the cargo space, and including a front edge and bottom left and right side edges;

a left connecting strip connected to the body, extending along the bottom left edge of the body, from a position at least adjacent the front edge of the body, and laterally projecting outside said bottom left edge, the left connecting strip being adapted to be secured on the container floor, between the left side wall of the container and the bottom left edge of the liner body; and a right connecting strip connected to the body, extending along the bottom right edge of the body, from a position at least adjacent the front edge of the body, and laterally projecting outside said bottom right edge, the right connecting strip being adapted to be secured on the container floor, between the right side wall of the container and the bottom right edge of the liner body.

2. A liner according to claim 1, for use with a container further having a front wall, and wherein:

the liner body includes a bottom panel adapted to extend over the floor of the container, a left side panel adapted to extend over the left side wall of the container, a right side panel adapted to extend over the right side wall of the container, and a front panel adapted to extend over the front wall of the container;

the liner further includes i) a reinforcing panel secured to and covering at least a portion of the bottom panel of the liner body, and ii) a securing panel extending across and laterally projecting outside the bottom panel of the liner body; and the securing panel forms the left and right connecting strips.

3. A liner according to claim 2, wherein:

the liner has a given length;

the left connecting strip extends along the bottom left edge of the liner body for a distance between about 20% and about 50% of the length of the liner; and the right connecting strip extends along the bottom right edge of the liner body for a distance between about 20% and 50% of the length of the liner.

4. A cargo container, comprising:

a container body defining an interior cargo space having a given shape, and including at least a floor;

a liner secured inside the container, and including i) a liner body positioned in the cargo space, and including a front edge and bottom left and right edges ii) a left connecting strip extending along and laterally projecting outside the bottom left edge of the liner body, the left connecting strip being held against the floor of the container and extending rearward from a position at least adjacent the front edge of the liner body, and iii) a right connecting strip extending along and laterally projecting outside the bottom right edge of the liner body, the right connecting strip being held against the floor of the container and extending rearward from a position at least adjacent the front edge of the liner body;

a left elongated securing member extending rearward, over the left connecting strip, from a position at least adjacent the front edge of the liner body, and releasably clamping the left connecting strip to the container floor; and a right elongated securing member extending rearward, over the right connecting strip, from a position at least adjacent the front edge of the liner body, and releasably clamping said right connecting strip to the container floor.

5. A cargo container according to claim 4, wherein:

the container body further includes left and right side walls and a front wall;

the liner body further includes i) a bottom panel extending over the floor of the container body, ii) a left side panel extending over the left side wall of the container body, iii) a right side panel extending over the right side wall of the container body, and iv) a front panel extending over the front wall of the container body;

the bottom and left side panels of the liner body form the bottom left edge thereof;

the bottom and right side panels of the liner body form the bottom right edge thereof; and the bottom and front panels of the liner body form the front edge thereof.

6. A cargo container according to claim 5, wherein:

the left connecting strip laterally extends outward from the left bottom edge of the liner body; and the right connecting strip laterally extends outward from the right bottom edge of the liner body.

7. A cargo container according to claim 5, wherein:

a first lower longitudinal portion of the left panel is held over a second lower longitudinal edge portion of the left panel to form the left connecting strip of the liner; and a first lower longitudinal edge portion of the right panel is held over a second lower longitudinal edge portion of the right panel to form the right connecting strip of the liner.

8. A cargo container according to claim 7, wherein:

the left connecting strip is formed by holding the left elongated securing member over the first and second lower longitudinal edge portions of the left panel; and the right connecting strip is formed by holding the right elongated securing member over the first and second lower longitudinal edge portions of the right panel.

9. A cargo container according to claim 5, wherein the liner further includes a reinforcing panel secured to the bottom panel of the liner.

10. A cargo container according to claim 9, wherein:

the bottom panel of the liner has a bottom surface; and the bottom reinforcing panel covers at least half of said bottom surface.

11. A cargo container according to claim 5, wherein:

the liner further includes a securing panel extending across and laterally projecting outside the bottom panel of the liner body; and the securing panel forms the left and right connecting strips.

12. A cargo container according to claim 5, wherein:

the liner body further includes a back panel spaced from and parallel to said front panel;

the distance between the front and back panels defines the length of the liner;

the left connecting strip extends along the bottom left edge of the liner, and the left securing member extends over the left connecting strip, for a distance equal to at least 20 percent of the length of the liner; and the right connecting strip extends along the bottom right edge of the liner, and the right securing member extends over the right connecting strip, for a distance equal to at least 20 percent of the length of the liner.

13. A cargo container according to claim 12, wherein:

the left connecting strip extends along the bottom left edge of the liner, and the left securing member extends over the left connecting strip, for a distance less than 50 percent of the length of the liner; and the right connecting strip extends along the bottom right edge of the liner, and the right securing member extends over the right connecting strip, for a distance less than 50 percent of the length of the liner.

14. A cargo container according to claim 13, wherein:

the left connecting strip extends rearward from the front edge of the liner; and the right connecting strip extends rearward from the front edge of the liner.

15. A method for installing a liner inside a container comprising:

placing the liner inside the container with a bottom panel of the liner over a floor of the container, with a bottom left edge of the liner adjacent a lower left edge of the container, with a bottom right edge of the liner adjacent a lower right edge of the container, and with a bottom front edge of the liner adjacent a lower front edge of the container;

positioning a left connecting strip of the liner between the bottom left edge of the liner and the lower left edge of the container, with the left connecting strip of the liner extending rearward from a position at least adjacent the bottom front edge of the liner;

positioning a right connecting strip of the liner between the bottom right edge of the liner and the lower right edge of the container, with the right connecting strip of the liner extending forward from a position at least adjacent the bottom back edge of the liner;

releasably clamping the left connecting strip to the container floor;

releasably clamping the right connecting strip to the container floor; and expanding the liner inside the container.

16. A method according to claim 15, wherein:

the step of releasably clamping the left connecting strip to the container floor includes the steps of i) placing a left elongated securing member over the left connecting strip, with the left securing member extending rearward from a position at least adjacent the front edge of the liner, and ii) releasably connecting the left securing member to the container floor; and the step of releasably clamping the right connecting strip to the container floor includes the steps of i) placing a right elongated securing member over the right connecting strip, with the right securing member extending rearward from a position at least adjacent the front edge of the liner, and ii) releasably connecting the right securing member to the container floor.

17. A method according to claim 16, wherein:

the liner includes a back edge and a front edge spaced from and generally parallel to the back edge of the liner, and the distance between the back and front edges of the liner defines the length of the liner;

the left connecting strip extends along the bottom left edge of the liner, and the left securing member extends over the left connecting strip, for a distance equal to at least 20 percent of the length of the liner; and the right connecting strip extends along the bottom right edge of the liner, and the right securing member extends over the right connecting strip, for a distance equal to at least 20 percent of the length of the liner.

18. A method according to claim 17, wherein:

the left connecting strip and the left securing member extend rearward from the front edge of the liner; and the right connecting strip and the right securing member extend rearward from the front edge of the liner.

19. A method for installing a liner inside a container, comprising:

placing the liner inside the container with a bottom panel of the liner over a floor of the container, with a bottom left edge of the liner adjacent a lower left edge of the container, with a bottom right edge of the liner adjacent a lower right edge of the container, and with a bottom front edge of the liner adjacent a lower front edge of the container;

positioning a left connecting strip of the liner between the bottom left edge of the liner and the lower left edge of the container, with the left connecting strip of the liner extending rearward from a position at least adjacent the bottom front edge of the liner, and including the step of forming the left connecting strip by holding first and second lower longitudinal portions of a left side panel of the liner against each other and over the container floor;

positioning a right connecting strip of the liner between the bottom right edge of the liner and the lower right edge of the container, with the right connecting strip of the liner extending forward from a position at least adjacent the bottom back edge of the liner, and including the step of forming the right connecting strip by holding first and second lower longitudinal portion of a right side panel of the liner against each other and over the container floor.

releasably clamping the left connecting strip to the container floor;

releasably clamping the right connecting strip to the container floor; and expanding the liner inside the container.

20. A method according to claim 19, wherein:

the step of holding the first and second lower longitudinal portions of the left side panel against each other includes the step of holding a left securing member on said first and second lower longitudinal portions of the left side panel; and the step of holding the first and second lower longitudinal portions of the right side panel against each other includes the step of holding a right securing member on said first and second lower longitudinal portions of the right side panel.

* * * * *